US005257495A

United States Patent [19]

Borsani et al.

[11] Patent Number: 5,257,495

[45] Date of Patent: Nov. 2, 1993

[54] AUTOMATIC PACKAGING MACHINE

[76] Inventors: Angel O. Borsani; Elena E. Chain, Both of Rio Hondo 1696, 1714 Ituzaingó, Bs. As., Argentina

[21] Appl. No.: 901,199

[22] Filed: Jun. 19, 1992

[30] Foreign Application Priority Data

Jul. 22, 1991 [CL] Chile ..... 678-91

[51] Int. Cl.[5] ..... B65B 43/28; B65B 43/44; B65B 43/48

[52] U.S. Cl. ..... 53/566; 53/377.2

[58] Field of Search ..... 53/566, 382.2, 382.3, 53/284, 377.2

[56] References Cited

U.S. PATENT DOCUMENTS 2,909,874 10/1959 Barr ..... 53/566 X
4,081,945 4/1978 Calvert et al. ..... 53/377.2 X
4,203,355 5/1980 Meyers ..... 53/377.2 X
4,244,282 1/1981 Ruzand et al. ..... 53/566 X
4,531,931 7/1985 Dietrich ..... 53/566 X
5,072,573 12/1991 Tisma ..... 53/566 X

*Primary Examiner*—Horace M. Culver
*Attorney, Agent, or Firm*—Edmund M. Jaskiewicz

[57] ABSTRACT

Automatic packaging machine having a dispenser for pre-shaped and planar boxes, connected to suckers actuated by vacuum cylinders taking the planar boxes and putting them into the first division of a feeder rack, the closure of the box lugs being attained by means of small and rotatory pneumatic cylinders and of fixed guides. The machine of the invention, being of small size, operates with reduced power and reduces excessive noise and high operation, cleaning, lubrication and maintenance costs.

5 Claims, 11 Drawing Sheets

AUTOMATIC PACKAGING MACHINE

FIELD OF THE INVENTION—PRIOR ART

The instant invention relates to an automatic packaging machine.

The object of the invention is to provide a machine for assembling and filling planar pre-shaped box blanks stacked into a loader, and for closing automatically said box blanks by binding the upper and lower lugs or flaps with adhesive or glue, or by inserting said flaps into the assembled box.

Another object of the invention is to provide an economic, quiet, and clean machine, which could be operated in a minimum of space and has low maintenance cost.

The above objects are attained with the machine of the invention as a result of the novel way in which it carries out the packaging of products.

The automatic packaging machine of the invention utilizes the action of small pneumatic cylinders, in view of the fact that low power is required for folding lugs of flexible material such as cardboard having a die-marked or scored fold line.

It is to be noted that known machines of this kind have used standard devices of other machines, carrying out the flap closing operations with a power a hundred times higher than that required to this purpose, which resulted in unnecessarily large machines, noisy operation, and increased expenses in cleaning, lubrication and service.

The use of pneumatic cylinders in packaging machines is not completely new, but the novelty resides in the use of small pneumatic cylinders and rotary pneumatic cylinders, and also in the use of fixed guides or cams for closing the box during the travel thereof along the machine.

BRIEF DESCRIPTION OF THE DRAWINGS

A preferred exemplary embodiment of the invention will be now described in connection with the accompanying drawings, in which.

In all figures the same reference numerals designate the same or equivalent parts.

DETAILED DESCRIPTION OF THE INVENTION

Figure 1:
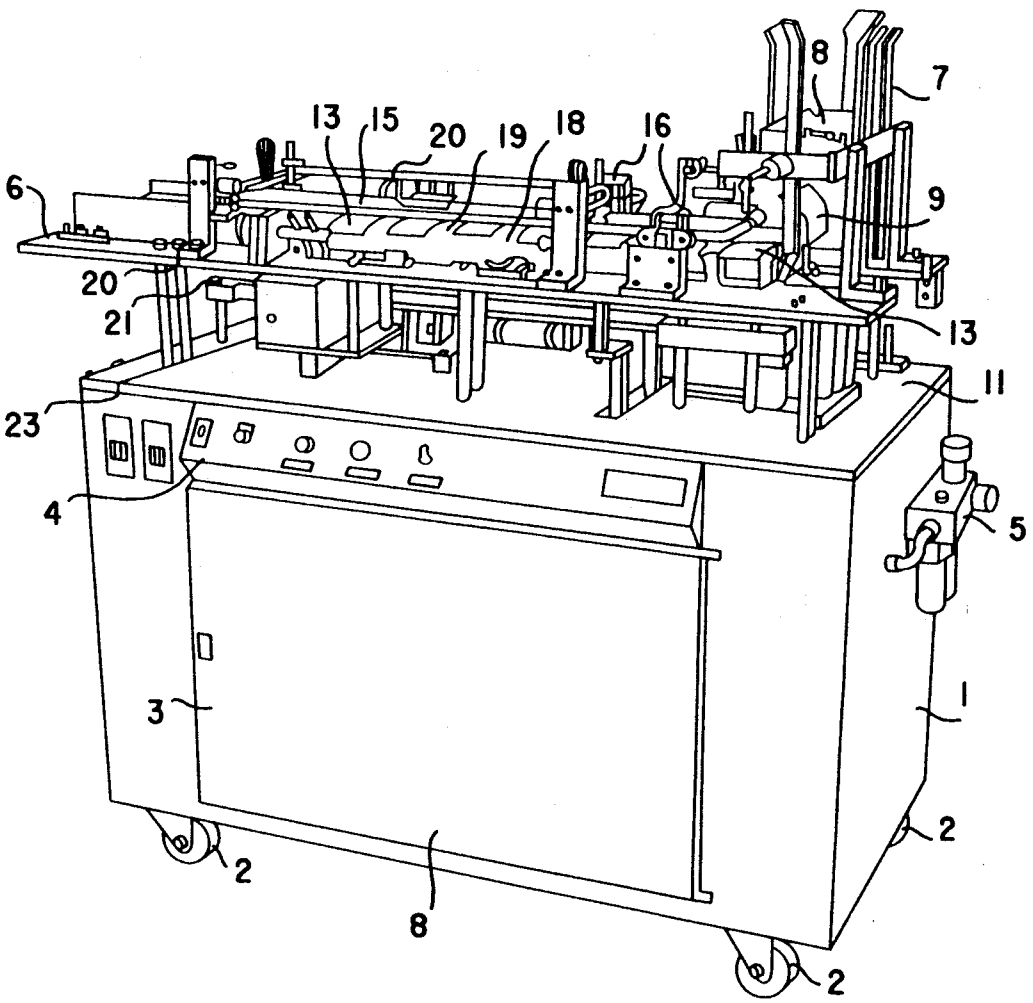
FIG. 1 is a general perspective view of the machine of the invention showing the means for closing the box by gluing.
Figure 2:
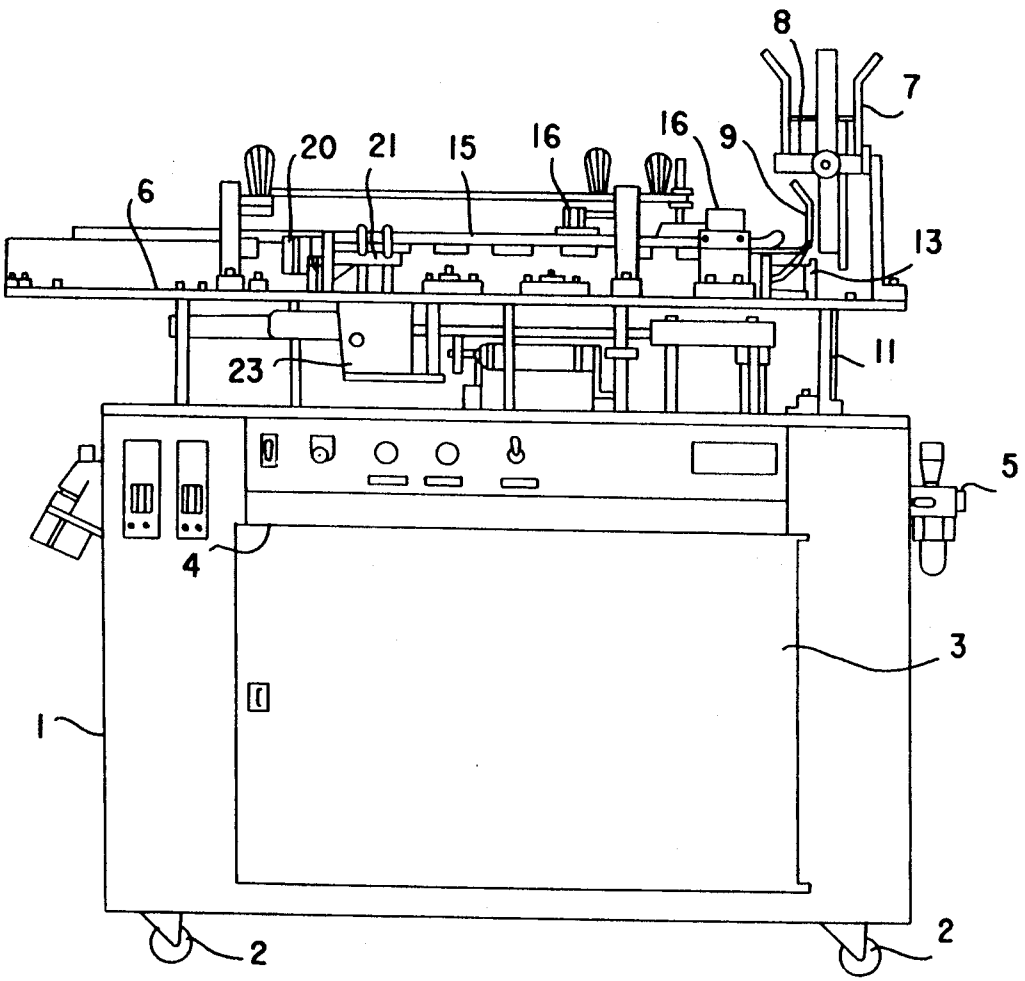
FIG. 2 is a front view of the same machine showing the box glue-closing means.

The machine of the invention comprises a cabinet 1 mounted on wheels 2.

The cabinet 1 houses pneumatic connections for driving the pneumatic cylinders to be described. Access to said connections is through door 3.

A control board 4 is located on said door 3.

On one of the sides of cabinet 1 there are control means, adjustment means and filters 5 corresponding to the pneumatic circuit of the packaging machine.

Cabinet 1 has a platform 6 on the upper portion thereof. A loader 7, dispensing planar pre-shaped box blanks 8, is mounted on platform 6 adjacent a side of the machine (FIGS. 1, 2, 3, 4, 7, 9 and 10).

It is to be noted that such pre-shaped boxes 8 are printed, die stamped, scored at their fold lines, adhered at their longitudinal side and stacked flat at a printing shop.

The loader 7 has, at the lower portion, a guide 9. This guide makes the planar box blank 8 to take its assembled box shape (with the upper and lower lugs open).

In order that the folded box blank 8 may pass through guide 9 the machine has a set of suction orifices 10 driven by vacuum cylinders 11 (FIG. 7) which suck and pull said boxes.

Figure 3:
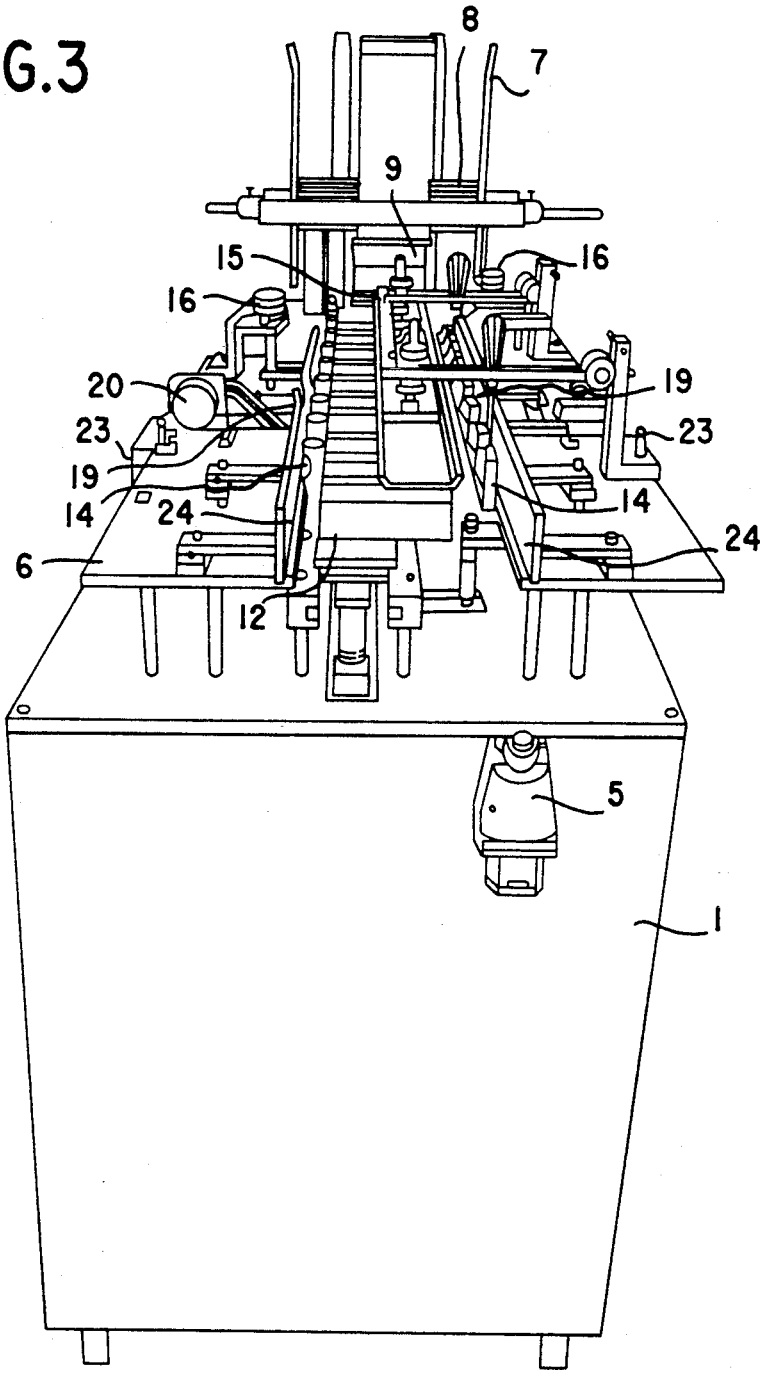
FIG. 3 is a side elevational view showing the outlet of the assembled box showing the glue-closing means.
Figure 4:
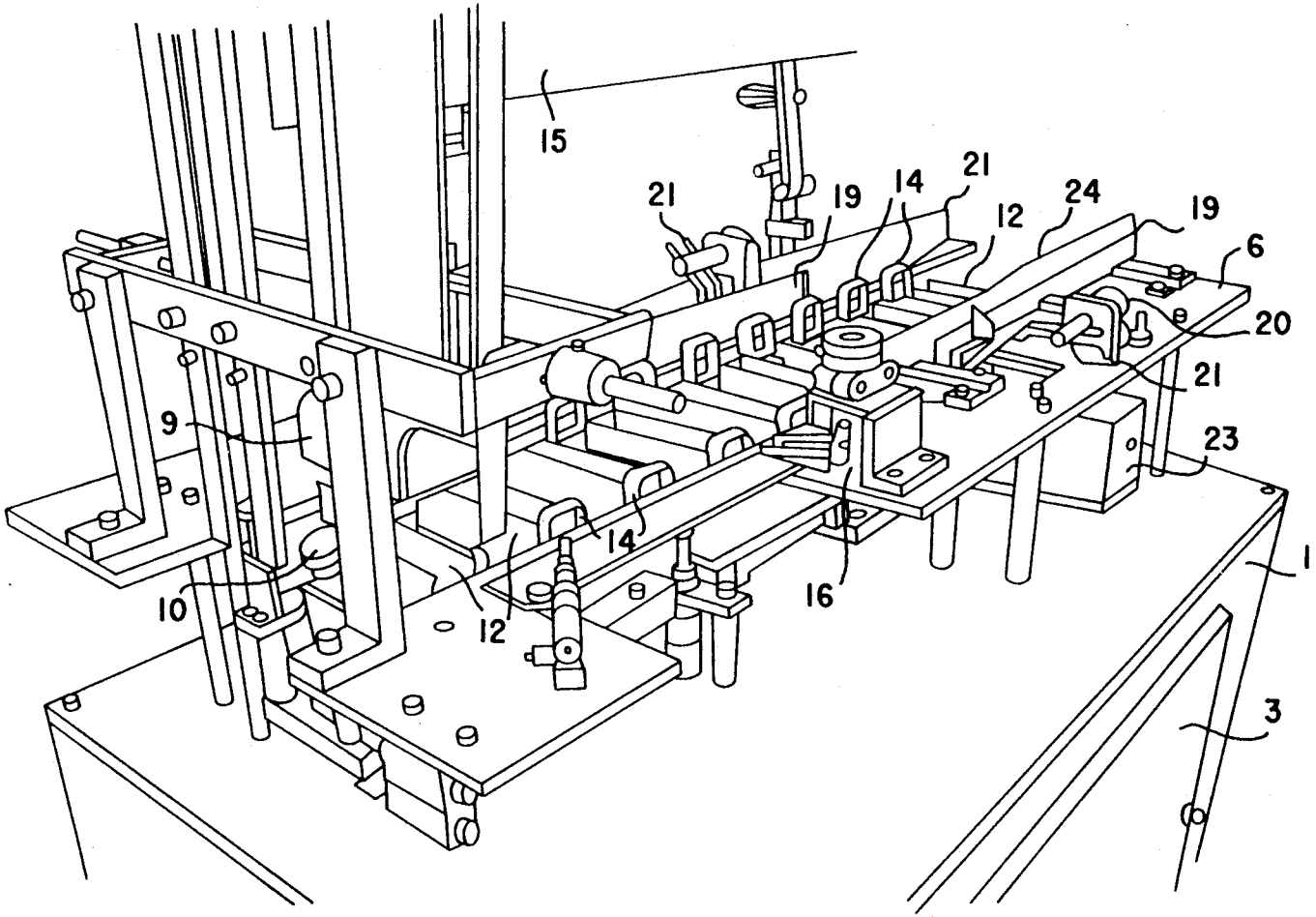
FIG. 4 is a perspective detail of the elements mounted on the machine platform from the loader angle, showing the glue-closing means.

The suction of vacuum cylinders 11 enables suction devices 10 to catch a box blank 8 forcing it through guide 9 and placing it, once assembled, on the first division of a feeder rack 12 (FIG. 3).

The number of divisions of rack 12 is variable, but in the preferred embodiment there are eight divisions.

These divisions of the feeder rack 12 have four movements, namely raising, lowering, forward and rearward. Such movements are produced by corresponding pneumatic cylinders.

The assembled box 13, after passing through guide 9 and after being placed into the first division of the feeder rack, 12 is shifted thereby from one division to the other until the box is filled with the product and completely closed by gluing of the flaps or by inserting the flaps.

In order to move the assembled box 13, the feeder rack 12 cooperates with corresponding guide racks 14 having raising and lowering movements.

The introduction of the assembled box 13 into the feeder rack 12 is always carried out when the feeder rack is raised.

Upon raising of the feeder rack 12, the two guide racks 14 are also raised and hold assembled boxes 13 of all divisions.

In this position, the feeder rack 12 lowers, retracts and takes a new box 8 from the loader 7.

The advance movement of the feeder rack 12 is always effected when the rack is raised, conveying the assembled boxes 13 into the divisions.

For folding the box flaps, the machine has fixed guides or cams and flap folders driven by pneumatic cylinders.

A foldable upper guide 15 serves as upper stop for the boxes being conveyed.

The feeder rack 12 advances in a predetermined stepwise mode the distance of which is determined by the width of the assembled box. In the present exemplary embodiment, the cycle from the pulling of unfolded box 8 up to the assembled box 13, loading of the product and closing of the flaps is carried out in eight steps, i.e. one step per division.

The box closure cycle by gluing is as follows:

During the first step vacuum cylinders 11 position the assembled box 13 into the first division of the feeder rack 12.

Figure 5:
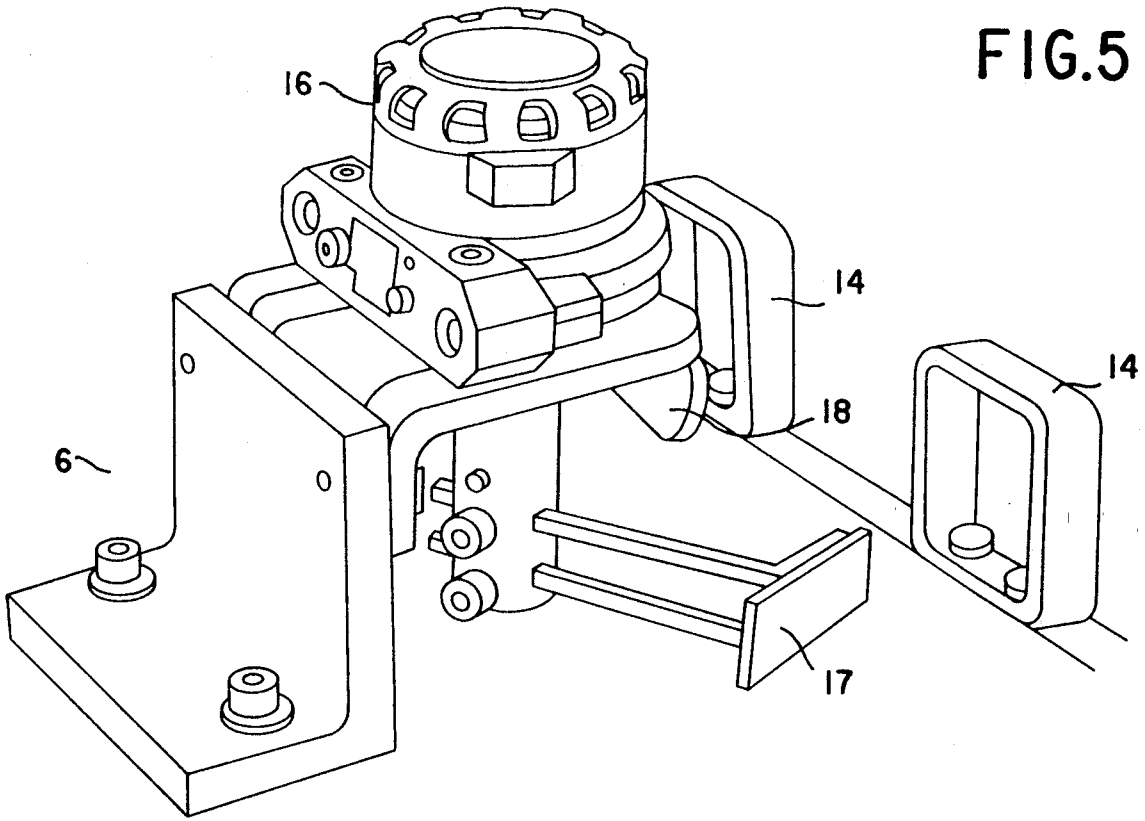
FIG. 5 is a detailed perspective of the adjustable rotary pneumatic cylinder.

An adjustable rotary pneumatic cylinder 16 (FIG. 5), by means of a shoe 17, folds a short lug of the box 13 at one of its ends.

The other short lug of the same portion is folded by a triangle-shaped short fixed guide 18 upon advancement of the feeder rack 12.

In the second step, the packaging machine stops for filling the box, by means of a device or bin coupled in accordance with the product to be packed.

In the third step, a rotatory pneumatic cylinder 16 effects, along with a short triangular fixed guide 18, the closure of short flaps at the other end of the box 13.

In the fourth step, a triangular long fixed cam guide 19 folds the first long inner lug of the box at one of its ends.

In the fifth step, another long triangular fixed guide 19 folds the first inner long lug, of the other end of the box 13.

Figure 6:
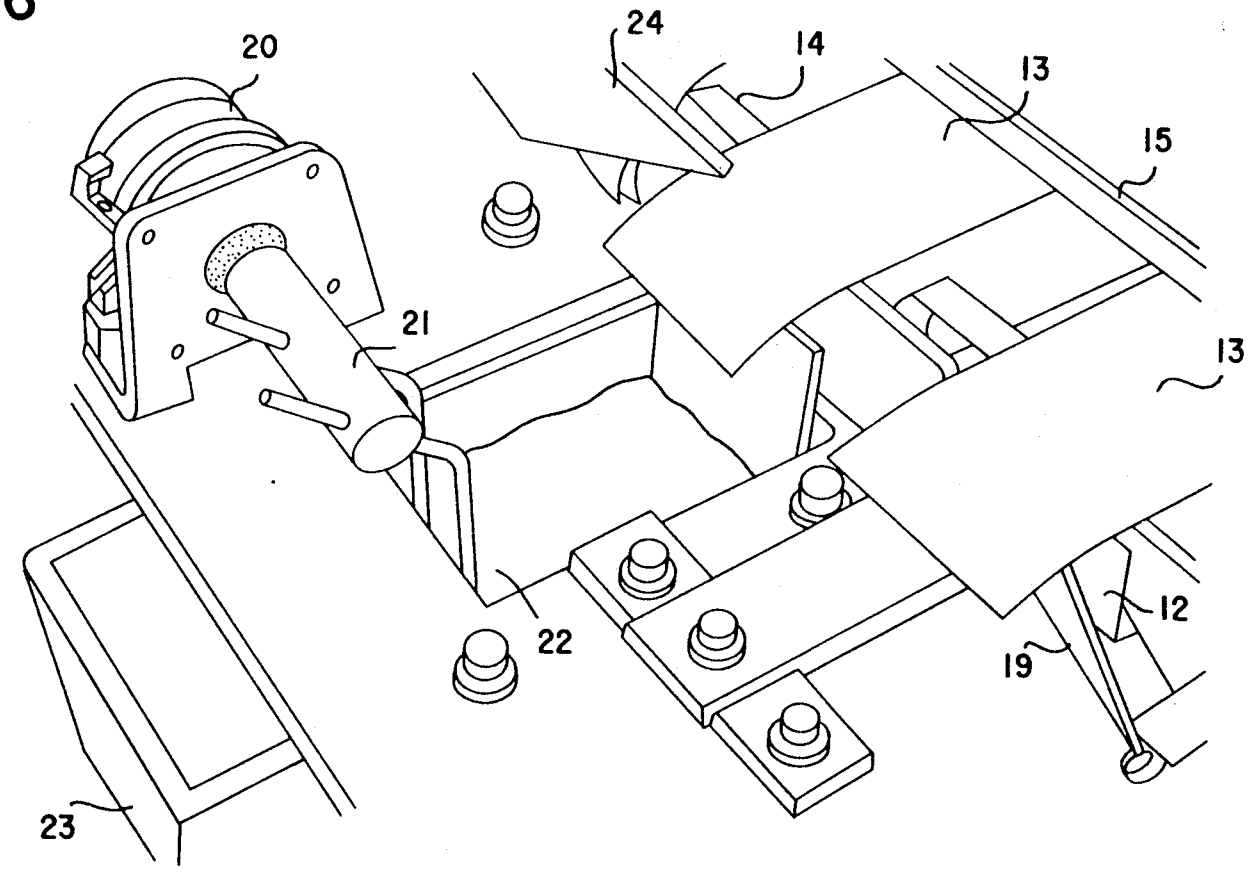
FIG. 6 is a detail of the pneumatic cylinder for rotatingly driving the gluing lugs and lugs introduced into the hot glue container.
Figure 7:
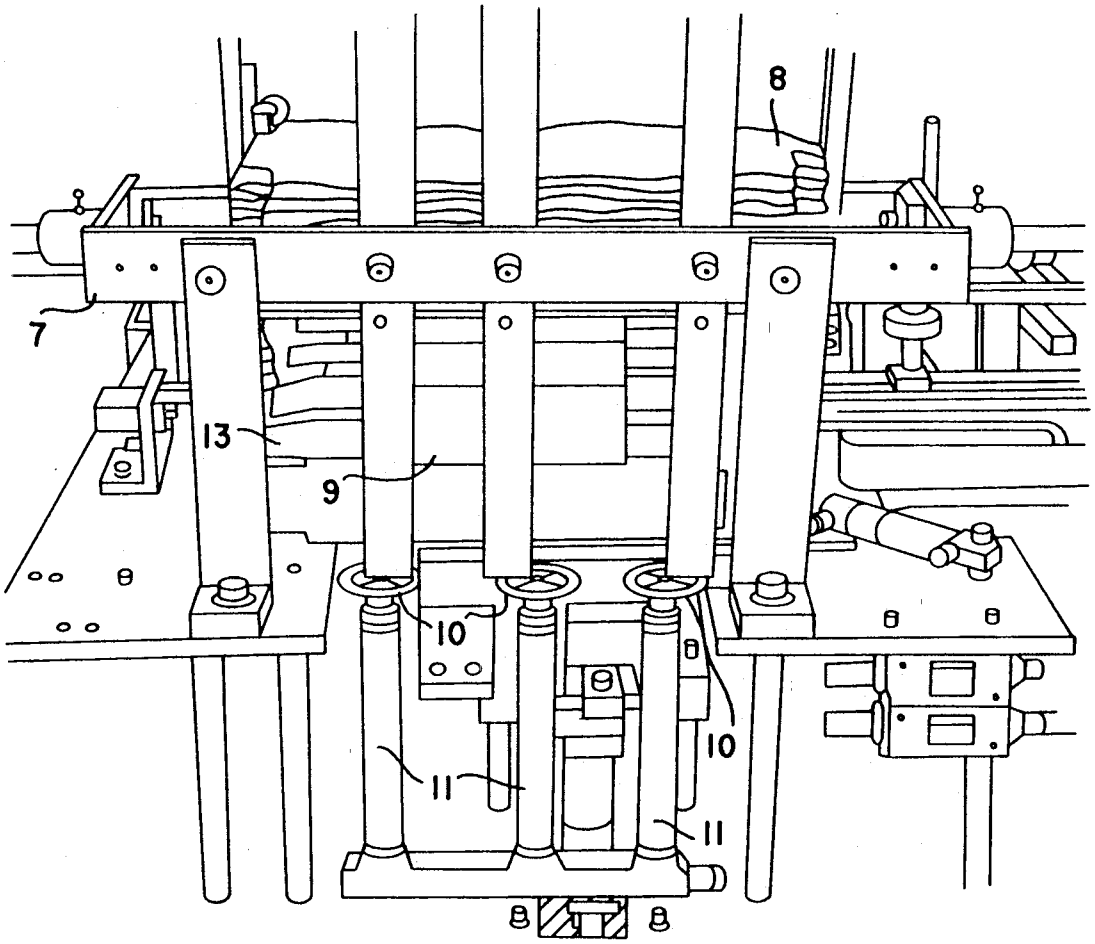
FIG. 7 is a detail of the suction orifices and vacuum cylinders, withdrawing the box blank from the loader.

In the sixth step, a pair of rotary pneumatic cylinders 20 each drive a shaft 21 with raises and lowers along a curved path a gluing tongue 22 which introduces into a hot adhesive container 23 and glues the corresponding outer long flaps on their front face when they raise (FIG. 6).

In the seventh step the outer long flap at one end of the box 13 is closed by means of a triangular long fixed guide 24. The adhesive being cooled and settled thus immediately bands this end of the box.

The eighth step is exactly the same as the seventh step in that the same structural elements are used and functions performed, but its function is to close the other end of the box 13, the box being thereby completely closed by means of gluing.

When the box is to be closed by inserting the flaps, the machine is adapted to this purpose.

In the first place, the glue container 23 is removed.

Closing of boxes in this case is made by means of elongated cam guides, the boxes 13 having a long inserting lug.

Figure 8:
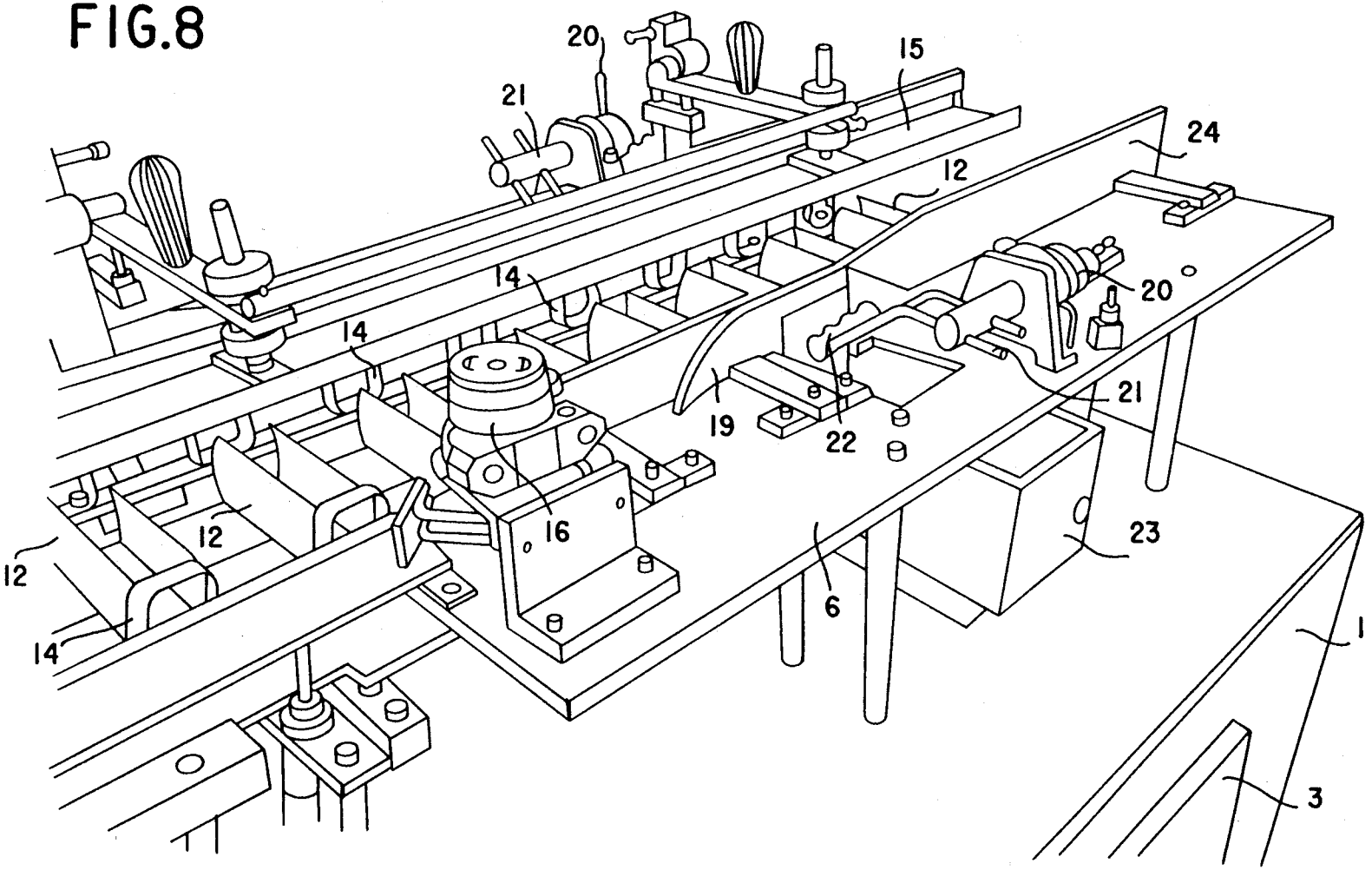
FIG. 8 is a detail of the platform portion on which fixed guides and reversible upper guide are located.
Figure 9:
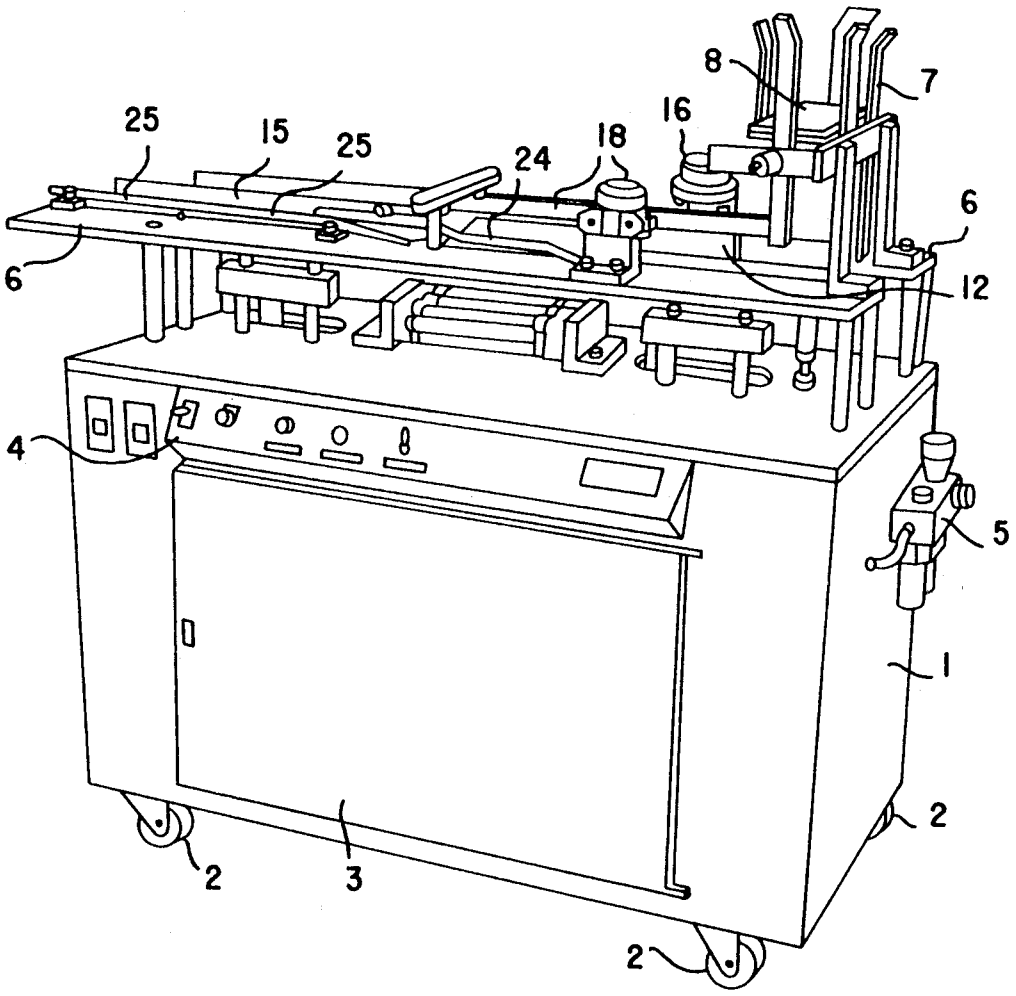
FIG. 9 is a view similar to that of FIG. 1, but having closure guide cams for closing the box by means of insertion of the flaps.
Figure 10:
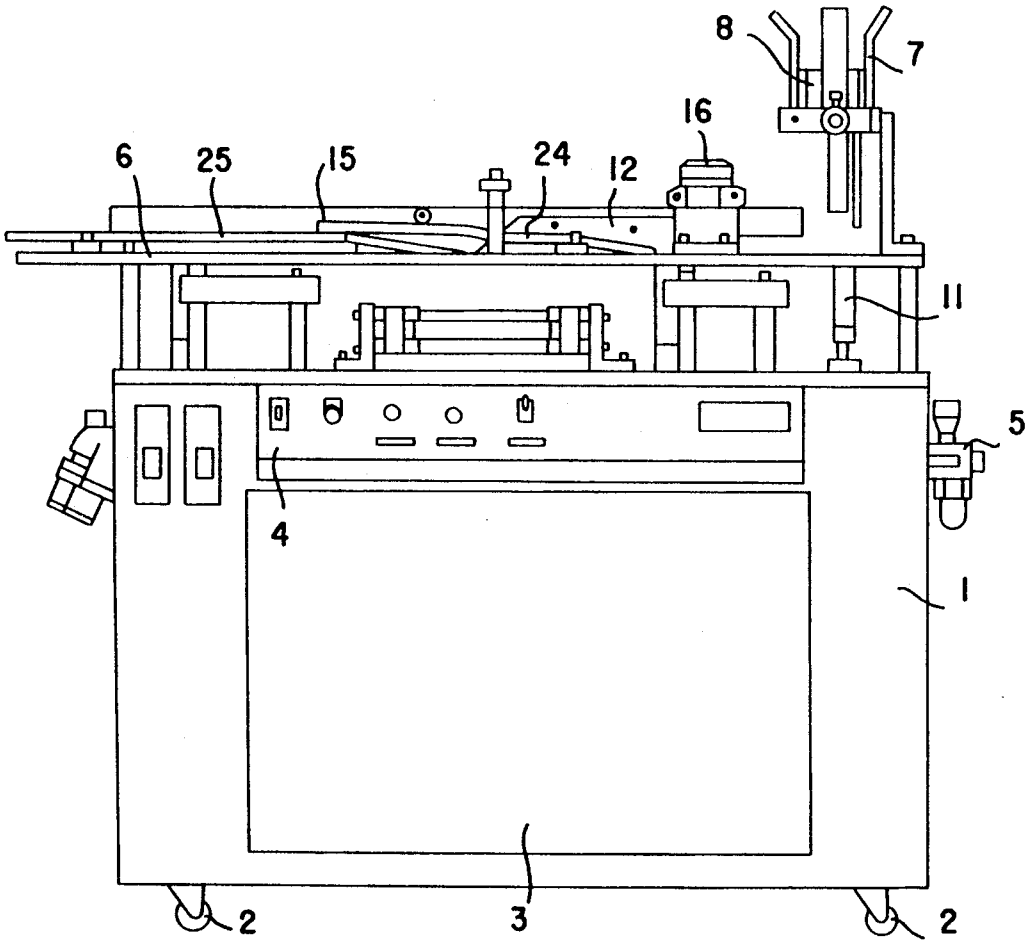
FIG. 10 is a view similar to that of FIG. 2, but having closure guide cams for closing the box by means of insertion of the flaps.
Figure 11:
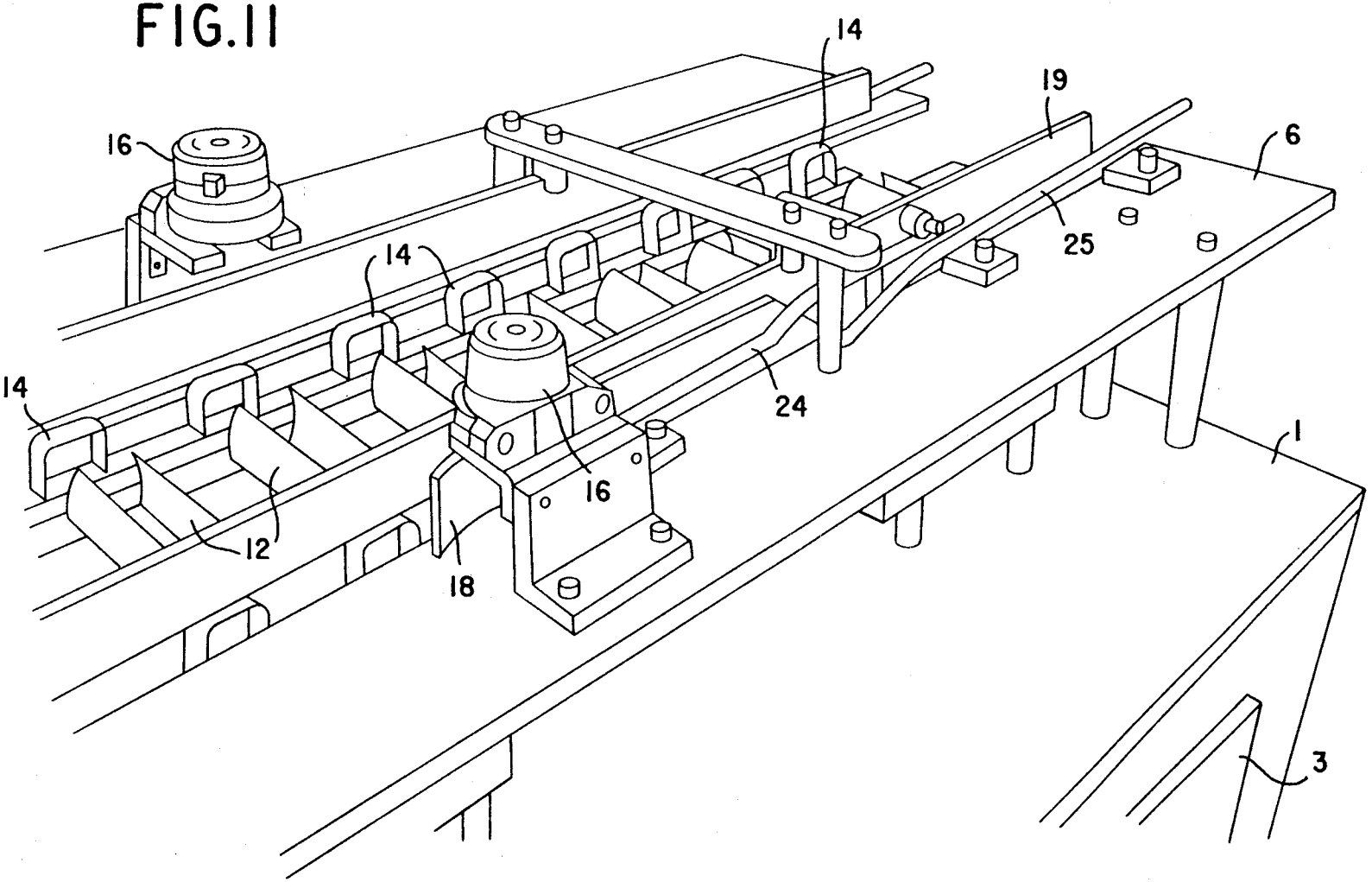
FIG. 11 is a view similar to that of FIG. 8, but having closure guide cams for closing the box by means of insertion of the flaps.

In FIGS. 9, 10 and 11 (similar to FIGS. 1, 2 and 8, respectively), devices for closing boxes by inserting the flaps are shown, the remaining elements being removed for the sake of clarity.

Up to the fourth step, the process is similar. In the fifth step a first curved elongated cam guide 24, starting flush with platform 6 raises gradually in a curved fashion with respect to the fold of the inserting flap of the box, until reaching a straight or vertical angle.

In the next step and before finishing the operation of the first elongated cam guide 24, there is a second curved elongated cam guide 25 which engages the cover flap of the box, raising gradually in a curved fashion until effecting the the cover flap is folded and inserting the insertion flap into the box between the front inner face and the short side flaps. The cover flap is pushed inwardly to the assembled box until a proper and firm closure of that end of the box is produced.

In the two subsequent steps and in a similar manner, the other end of the box is closed. The box is now filled with product and completely closed, and is ejected from the machine, while a new box enters the first division of the feeder rack 12 to begin a new cycle.

While the invention has been described in conjunction with a specific embodiment, it is to be understood that many alternatives, modifications and variations will be apparent to those skilled in the art in light of the foregoing description. Accordingly, this invention is intended to embrace all such alternatives, modifications and variations which fall within the spirit and scope of the appending claims.

We claim:

1. An automatic packaging machine for closing and gluing the ends of pre-shaped flat box blanks having die marked fold lines defining end flaps and sides thereof, comprising a frame, a loader at one end of said frame storing a plurality of stacked flat box blanks, vacuum feed means under said loader for pulling a box blank from said loader, guide means under said loader for assembling a box blank pulled there through into an assembled box having an opposed pair of open unfolded short flaps and an opposed pair of open unfolded long flaps at both ends thereof, a feeder rack under said guide means having a plurality of divisions thereon and a first of said divisions receiving said assembled box, means for driving said feeder rack up-down and forward-rearward a distance corresponding to the width of an assembled box, a pair of guide racks along side said feed rack movable up-down corresponding to the up-down movement of said feeder rack such that when said feeder rack is in a raised position the guide racks will support an assembled box while the feeder rack moves forwardly and downwardly and inserts a successive assembled box into a preceding division of said feeder rack when the feeder rack is raised again, a first rotatable pneumatic cylinder on said frame on one side of said feeder rack adjacent said first division thereof and actuating a shoe to fold a short flap on one end of said assembled box and a first fixed guide for folding the other short flap on said one end, a second rotatable pneumatic cylinder on said frame on the other side of said feeder rack adjacent a further division thereof and actuating a shoe to fold a short flap on the other end of said assembled box and a second fixed guide for folding the other short flap on said other end of the assembled box, third and fourth fixed guides on both sides of said feeder rack adjacent still further divisions thereon engagable with one of a pair of long flaps at both ends of a said assembled box to fold said one long flap against the folded short flaps, means on both sides of said feeder rack for applying an adhesive to an underside of each of the other of a pair of long flaps at both ends of a said assembled box, and fifth and sixth fixed guides on both sides of said feeder rack each engagable with the other of the pair of long flaps to fold said long flap underside having adhesive thereon against said folded one of said long flaps to close both ends of the assembled box.

2. An automatic packaging machine as claimed in claim 1 wherein each of said means for applying an adhesive comprising a third rotary pneumatic cylinder driving a shaft and a adhesive applying tongue on said shaft, and a container of adhesive below said third rotary pneumatic cylinder to receive said tongue in said adhesive such that the rotation of said shaft will bring said tongue with adhesive thereon against said underside of a long end flap.

3. An automatic packaging machine for closing the ends of pre-shaped flat box blanks having die marked fold lines defining end flaps and sides by insertion of end flaps into an assembled box, comprising a frame, a loader at one end of said frame storing a plurality of stacked flat box blanks, vacuum feed means under said loader for pulling a box blank from said loader, guide means under said loader for assembling a box blank pulled there through into an assembled box having an opposed pair of open unfolded short flaps and an unfolded long flap having an insertion flap thereon at both ends thereof, a feeder rack under said guide means having a plurality of divisions thereon and a first of said divisions receiving said assembled box, means for driving said feeder rack up-down and forward-rearward a distance corresponding to a width of an assembled box, a pair of guide racks along said fixed rack movable up-down corresponding to the up-down movement of said feeder rack such that when said feeder rack is in a raised position the guide rack will support an assembled box while the feeder rack moves forwardly and downwardly and inserts a successive assembled box into a preceding division of said feeder rack when the feeder rack is raised again, a first rotatable pneumatic cylinder on said frame on one side of said feeder rack adjacent said first division thereof and actuating a shoe to fold a short flap on one end of said assembled box and a first fixed guide for folding the other short flap on said one end, a second rotatable pneumatic cylinder on the other side of said feeder rack adjacent a further division thereof and actuating a shoe to fold a short flap on the other end of said assembled box and a first fixed guide for folding the other short flap on said other end, a first elongated cam guide gradually rising in the forward direction and engaging said insertion flap to fold said insertion flap into a substantially vertical position, and a second elongated cam guide forwardly of said first elongated cam guide and rising gradually in the forward direction to engage said long flap on an end of said assembled box and fold said long flap toward said assembled box until said folded insertion flap is inserted between a side said assembled box and the folded short flaps at said box end.

4. An automatic packaging machine as claimed in claim 3 wherein said second elongated cam guide has its beginning before the end of said first elongated cam guide.

5. An automatic packaging machine as claimed in claim 3 wherein said first and second elongated cam guides each begin flush with a surface of said frame along which said box blanks are being moved by said feeder rack.

* * * * *